US010729188B2

(12) United States Patent
Meillassoux et al.

(10) Patent No.: US 10,729,188 B2
(45) Date of Patent: Aug. 4, 2020

(54) SUIT FOR AQUATIC ACTIVITY

(71) Applicant: DECATHLON, Villeneuve d'Ascq (FR)

(72) Inventors: Olivia Meillassoux, Hendaye (FR); Marie-Thérèse Cotza, Hendaye (FR)

(73) Assignee: DECATHLON, Villeneuve d'Ascq (FR)

( * ) Notice: Subject to any disclaimer, the term of this patent is extended or adjusted under 35 U.S.C. 154(b) by 101 days.

(21) Appl. No.: 16/093,768

(22) PCT Filed: Apr. 4, 2017

(86) PCT No.: PCT/FR2017/050790
§ 371 (c)(1),
(2) Date: Oct. 15, 2018

(87) PCT Pub. No.: WO2017/178730
PCT Pub. Date: Oct. 19, 2017

(65) Prior Publication Data

US 2019/0125009 A1 May 2, 2019

(30) Foreign Application Priority Data

Apr. 15, 2016 (FR) ..... 16 53364

(51) Int. Cl.
*A41D 13/012* (2006.01)
*B63C 11/04* (2006.01)
(Continued)

(52) U.S. Cl.
CPC ..... *A41D 13/012* (2013.01); *A41D 7/00* (2013.01); *B63C 11/04* (2013.01);
(Continued)

(58) Field of Classification Search
CPC ..... B63C 11/04; B63C 2011/046; B63C 2011/043; B63C 9/087; B63C 9/093;
(Continued)

(56) References Cited

U.S. PATENT DOCUMENTS 1,489,046 A * 4/1924 Thompson ..... A41B 9/08 2/114
1,706,097 A * 3/1929 Aud ..... B63C 9/093 441/103

(Continued)

FOREIGN PATENT DOCUMENTS

DE 102004033165 A1 1/2006
EP 0099166 A1 1/1984

(Continued)

OTHER PUBLICATIONS

International Search Report issued in corresponding application No. PCT/FR2017/050790, dated Jul. 17, 2017.

*Primary Examiner* — Robert H Muromoto, Jr.
(74) *Attorney, Agent, or Firm* — Murtha Cullina LLP

(57) ABSTRACT

The invention relates to a suit for aquatic activities, having a central part intended to cover the torso of the wearer as a close fit, the central part being formed between a ventral panel and a dorsal panel which are connected to one another laterally creating a top opening. The suit also includes two lateral openings and two lower openings with the ventral panel having a main slit extending between the upper opening and a lower end, the main slit to being equipped with a reversible opening device to allow the suit to be put on and taken off by transversely opening the ventral panel. The suit comprising an additional slit which extends in the dorsal panel between two ends, respectively an upper end and a lower end, the additional slit being equipped with a
(Continued)

reversible opening device so as to allow the dorsal panel to be released transversely to make the suit easier to take off.

13 Claims, 1 Drawing Sheet

(51) Int. Cl.
*A41D 7/00* (2006.01)
*A41D 13/02* (2006.01)

(52) U.S. Cl.
CPC .... *A41D 2200/20* (2013.01); *A41D 2300/322* (2013.01); *A41D 2400/44* (2013.01); *A41D 2400/70* (2013.01); *B63C 2011/046* (2013.01)

(58) Field of Classification Search
CPC ..... A41D 13/012; A41D 13/02; A41D 7/00; A41D 2400/24; A41D 13/129; A41D 2400/44; A41D 2200/20; A41D 13/0002; A41D 3/005; A41B 13/005; A41B 1/10; A41F 1/00; A62B 17/001
See application file for complete search history.

(56) References Cited

U.S. PATENT DOCUMENTS 2,008,152 A * 7/1935 Nier ..... A41D 13/02 2/79
2,428,198 A * 9/1947 Brohard, Jr. ..... A41D 1/02 2/96
2,517,748 A * 8/1950 Williams ..... A44B 19/32 2/82
2,523,175 A * 9/1950 Yates ..... A41B 1/10 2/128
2,582,811 A * 1/1952 Williams ..... A41D 13/012 2/2.17
2,738,512 A * 3/1956 Winer ..... A41B 13/005 2/80
2,773,263 A * 12/1956 Pompa ..... A41D 13/02 2/96
3,058,187 A * 10/1962 Gugen ..... A41F 1/00 24/585.11
3,463,150 A * 8/1969 Penfold ..... B64G 6/00 128/202.11
3,493,972 A * 2/1970 Oldham ..... B63C 11/04 2/2.17
3,643,264 A * 2/1972 Rector ..... A44B 18/00 2/2.17
3,731,319 A * 5/1973 O'Neill ..... A41D 13/012 2/2.17
3,771,169 A * 11/1973 Edmund ..... B63C 11/04 2/2.17
4,055,174 A * 10/1977 LeVasseur ..... A63B 31/08 128/201.11
4,242,769 A * 1/1981 Rayfield ..... A41D 13/002 441/91
4,275,467 A * 6/1981 Doelter ..... A41D 13/012 2/82
4,365,351 A * 12/1982 Doerschuk ..... B63C 11/04 2/2.15
4,464,795 A * 8/1984 Long ..... B63C 11/04 2/2.17
D279,135 S * 6/1985 Fletcher ..... D2/739
4,741,050 A * 5/1988 O'Kane ..... A41D 13/02 112/413
4,809,364 A * 3/1989 Lent ..... A41D 13/012 2/2.15
4,829,603 A * 5/1989 Schnoor ..... A41D 13/02 2/69
4,862,517 A * 9/1989 Meistrell ..... B63C 11/04 2/2.17
5,007,112 A * 4/1991 Lewis, Jr. ..... A41D 13/02 2/457
5,058,208 A * 10/1991 Adams ..... A41B 13/005 2/227
5,062,159 A * 11/1991 Jakub ..... A41D 13/1236 2/105
5,084,914 A * 2/1992 Hesch ..... A41D 13/129 2/227
5,153,938 A * 10/1992 Epperson ..... B64D 10/00 2/2.14
5,153,940 A * 10/1992 Bergquist ..... A41B 13/005 2/114
5,191,658 A * 3/1993 Meistrell ..... A41D 13/012 2/2.17
5,196,240 A * 3/1993 Stockwell ..... A41D 13/0005 427/389.9
5,630,229 A * 5/1997 Machado ..... A41D 13/012 2/2.15
5,768,703 A * 6/1998 Machado ..... A41D 13/012 2/2.15
5,806,090 A * 9/1998 Johnson ..... B63C 11/04 2/2.15
5,826,274 A * 10/1998 Thompson ..... A41D 13/012 2/69
5,887,279 A * 3/1999 Elting ..... A41D 13/1263 2/114
5,896,578 A * 4/1999 Hunter ..... A41D 13/012 2/2.15
5,898,934 A * 5/1999 Hunter ..... A41D 13/012 2/2.15
5,911,312 A * 6/1999 Holyfield ..... A41D 13/1263 2/69
5,940,879 A * 8/1999 Whitehouse ..... A41D 13/012 2/2.15
5,960,475 A * 10/1999 Fewtrell ..... A41D 13/02 2/82
6,038,699 A * 3/2000 Han ..... A41D 13/02 2/69
6,108,815 A * 8/2000 Majerfeld ..... A41D 3/06 2/247
6,219,841 B1 * 4/2001 Anderson ..... B63C 11/04 2/2.17
6,357,048 B2 * 3/2002 Griffiths ..... B63C 11/04 2/2.17
6,397,403 B1 * 6/2002 Waldman ..... A41D 23/00 2/468
6,415,440 B1 * 7/2002 Stinton ..... A41D 13/012 2/2.17
6,446,264 B2 * 9/2002 Fairhurst ..... A41D 7/00 2/2.15
6,473,904 B2 * 11/2002 Long ..... B63C 11/04 2/126
6,477,712 B1 * 11/2002 Jones ..... A41D 7/00 2/2.15
6,526,584 B1 * 3/2003 Hunter ..... A41D 13/012 2/2.15
6,675,389 B1 * 1/2004 Kublick ..... B63C 11/04 2/128
D513,715 S * 1/2006 Fayle ..... D11/221
7,028,345 B2 * 4/2006 Waldman ..... A41D 27/18 2/468
7,096,506 B2 * 8/2006 Ragot ..... A41D 13/012 2/2.15
7,188,371 B2 * 3/2007 Ragot ..... A41D 13/012 2/2.15
8,561,212 B2 * 10/2013 Saotome ..... B63C 11/04 2/2.15
8,578,512 B2 * 11/2013 Moore ..... A41D 13/012 2/2.16
8,819,865 B1 * 9/2014 Crye ..... A62B 17/001 2/2.14
D734,593 S * 7/2015 Borovicka ..... D2/831
9,119,428 B2 * 9/2015 Kuelker ..... A41D 13/02
9,572,378 B2 * 2/2017 Canales ..... A41D 13/012
D783,945 S * 4/2017 Van Sisseren ..... D2/831
D784,193 S * 4/2017 Freddi ..... A41D 3/005 D11/221
10,085,494 B2 * 10/2018 Canales ..... A41D 13/0125

(56) References Cited

U.S. PATENT DOCUMENTS

| | | | | |
|---|---|---|---|---|
| 10,093,401 | B2 * | 10/2018 | Myerscough | A41D 13/012 |
| 10,463,089 | B2 * | 11/2019 | Cheuk | A41D 27/18 |
| 2004/0055069 | A1 * | 3/2004 | Clarke Fayle | A41D 3/00 2/93 |
| 2004/0078876 | A1 * | 4/2004 | Wilson | A41D 13/0002 2/458 |
| 2005/0028241 | A1 * | 2/2005 | Ragot | A41D 13/012 2/69 |
| 2007/0277278 | A1 * | 12/2007 | O'Brien | B63C 9/087 2/2.17 |
| 2008/0216218 | A1 * | 9/2008 | McKinney | A62B 17/006 2/457 |
| 2013/0042377 | A1 * | 2/2013 | Moore | B63C 11/04 2/2.16 |

FOREIGN PATENT DOCUMENTS

| | | | |
|---|---|---|---|
| EP | 1277652 | A1 | 1/2003 |
| FR | 1561257 | A | 3/1969 |

* cited by examiner

SUIT FOR AQUATIC ACTIVITY

CROSS-REFERENCE TO RELATED APPLICATION

This application claims the benefit of International application number PCT/FR2017/050790, filed Apr. 4, 2017 and French patent application number 1653364, filed on Apr. 15, 2016, the entire contents of which are incorporated herein by reference

TECHNICAL FIELD

The invention relates to a suit for the practice of an aquatic activity.

BACKGROUND

It applies in particular to the practice of aquatic activities that involve an at least partial immersion of the body of the wearer in water, whether permanently, for example for swimming or deep-sea diving, or occasionally, for example for windsurfing, surfing or jet-ski.

In a known manner, suits for this type of activity have a central portion intended to cover the torso of the wearer as a close fit, mainly for insulating him from water, in particular in the case of prolonged immersion in water with a low temperature, but also in order to improve his floatability and/or the fluidity of his movements, in particular in the framework of practicing swimming.

The central portion is formed between a ventral panel and a dorsal panel which are connected to one another laterally by creating an upper opening, two lateral openings and two lower openings for the passage of respectively the head, the two arms and the two legs of the wearer.

In certain embodiments, the upper opening can be surmounted by a hood intended to cover the head and the neck of the wearer by leaving his face exposed, which is in particular the case for suits intended for the practice of deep-sea diving.

Moreover, the lateral and/or lower openings can be provided with a sleeve for at least partially covering respectively the arms and the legs of the wearer, the sleeves being formed from a single part with the central portion or from separated parts that are added onto the central portion.

The central portion, the hood and/or the sleeves can be made from a waterproof material and which has an elasticity that is sufficient to adjust them to the portion of the body of the wearer whereon they are arranged. To this effect, the use of neoprene is particularly advantageous, as it has, in addition to a good seal and good elasticity, good properties in terms of lightness, resistance to wear and shape memory.

Moreover, it is known to arrange on the ventral panel a main slit that extends between the upper opening and a lower end of the central portion, the main slit being equipped with a reversible opening device, for example a zip closure, to allow for the putting on and taking off of the suit by transversely separating the ventral panel.

However, due to the adjusting thereof to the body of the wearer, the putting on and taking off of such a suit is relatively difficult in practice, in particular for passing the shoulders, which form the widest zone of the torso of the wearer. Because of this, the wearer can be forced to ask for the assistance of another person, in particular by traction on the openings and/or the sleeves.

In order to attempt to overcome these disadvantages, it is known from document FR-1 561 257 a suit that further comprises an additional slit that extends substantially horizontally on a lower zone of the dorsal panel, the additional slit being provided with a zip closure in order to facilitate taking off the suit.

However, this solution does not provide entire satisfaction, in that the additional slit does not make it possible to sufficiently increase the extensibility of the main slit in order to genuinely facilitate the taking off of the suit. In particular, the additional slit is too far from the shoulders to facilitate the passage thereof through the main slit.

SUMMARY OF THE INVENTION

The invention aims to improve the prior art by proposing notably a suit arranged to allow the wearer to put it on and to take it off more easily, and this without altering the performance of the suit with respect to the practice of the aquatic activity.

To this effect, the invention proposes a suit for aquatic activity that has a central portion intended to cover the torso of the wearer as a close fit, the central portion being formed between a ventral panel and a dorsal panel which are connected to one another laterally by creating an upper opening, two lateral openings and two lower openings for the passage of respectively the head, the two arms and the two legs of the wearer, the ventral panel having a main slit extending between the upper opening and a lower end, the main slit being equipped with a reversible opening device to allow the suit to be put on and taken off by transversely separating the ventral panel, the suit comprising an additional slit which extends in the dorsal panel between two ends, respectively an upper end and a lower end, the additional slit being equipped with a reversible opening device in order to allow for a transversal release of the dorsal panel to make the suit easier to take off.

BRIEF DESCRIPTION OF THE DRAWINGS

Other particularities and advantages of the invention shall appear in the following description, given in reference to the accompanying figures, wherein.

DETAILED DESCRIPTION

Figure 1A:
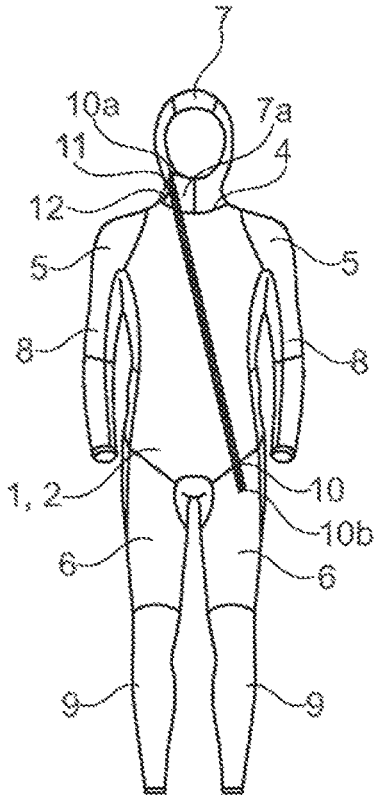
FIGS. 1*a*, 1*b* and 1*c* show a suit according to an embodiment of the invention, respectively as a front view (FIG. 1*a*), as a side view (FIG. 1*b*) and as a view from the back (FIG. 1*c*)
Figure 1B:
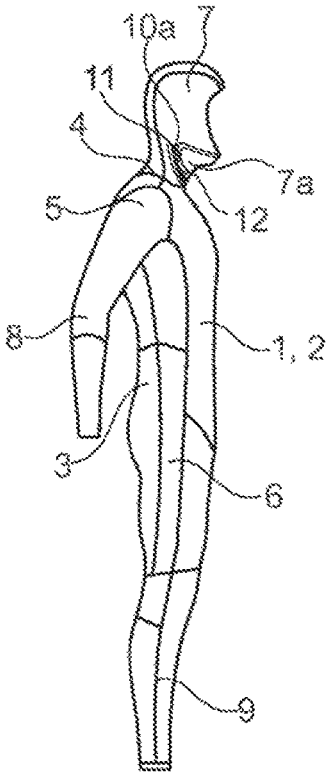
Figure 1C:
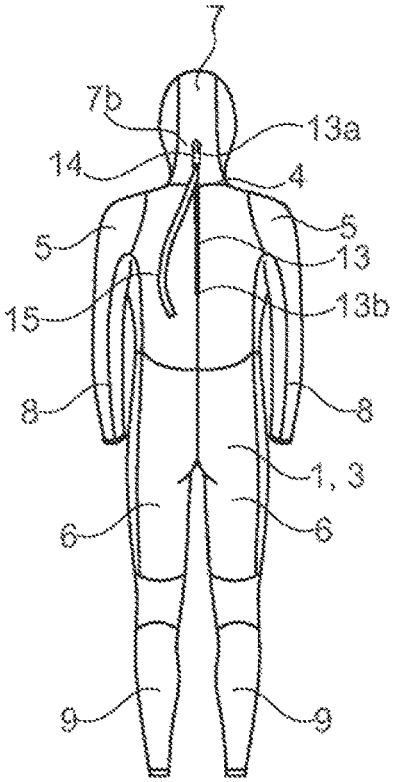

In relation with these figures, hereinbelow a suit is described for the practice of an aquatic activity, for example swimming, deep-sea diving, windsurfing, surfing or jet-ski, indoors, for example in a pool, as well as outdoors, for example in the sea, a lake or a river.

The suit has a central portion 1 intended to cover the torso of the wearer as a close fit, for example to insulate him from water so as to protect him from the cold, in particular in case of prolonged immersion in water with a low temperature, or to improve his floatability and/or the fluidity of his movements, in particular in the framework of the practice of swimming.

The central portion is formed between a ventral panel 2 and a dorsal panel 3 which are connected to one another laterally by creating an upper opening 4, two lateral openings 5 and two lower openings 6 for the passage of respectively the head, the two arms and the two legs of the wearer. In particular, the lateral connection between the ventral 2 and dorsal 3 panels is located substantially in the front plane of the torso of the wearer.

According to an embodiment, the ventral 2 and dorsal 3 panels are made from a single part, the lateral connection between them then being continuous. According to another embodiment, the ventral 2 and dorsal 3 panels are made from one or several parts each, the parts being associated together, for example with a waterproof seam or via a weld, in order to laterally connect the panels on a lateral seam or continuously.

In the embodiment shown, the upper opening 4 is surmounted by a hood 7 intended to cover the head and the neck of the wearer by leaving his face exposed, which makes the suit particularly suitable for deep-sea diving.

Moreover, the lateral openings 5 and the lower openings 6 are provided with a sleeve 8, 9 for at least partially covering respectively the arms and the legs of the wearer, the sleeves being formed from a single part with the central portion 1 or from separated parts which are added, for example with a waterproof seam or via a weld, on the central portion 1.

In the figures, the lateral 8 and lower 9 sleeves have lengths that are sufficient to entirely cover the arms and the legs of the wearer, so as to leave only the hands and the feet exposed. Alternatively, the sleeves 8, 9 can have a length arranged to cover only a portion of the arms and of the legs, for example only the upper portion of the arms located above the elbow (for the lateral sleeves 8) or the thighs (for the lower sleeves 9), even only half of the upper arm portions or of the thighs.

The ventral 2 and dorsal 3 panels, the hood 7 and/or the sleeves 8, 9 can be made from waterproof material and having an elasticity that is sufficient to adjust them to the portion of the body of the wearer whereon they are arranged. To this effect, the use of neoprene is particularly advantageous, as it has, in addition to a good seal and good elasticity, good properties in terms of lightness, resistance to wear and shape memory.

The ventral panel 2 has a main slit 10 that extends between the upper opening 4 and a lower end 10*b*, the main slit being equipped with a reversible opening device in order to make it possible to put on and to take off the suit by transversely separating the ventral panel.

In the embodiment shown, the reversible opening device comprises a zip closure, of which the cursor 11 is provided with a grip tab 12, for example made of fabric, in order to facilitate the grasping and the handling by the wearer.

In order to improve the transversal separating of the ventral panel 2, and as such facilitate the putting on and the taking off of the suit, the main slit 10 extends over substantially the entire height of the ventral panel. Furthermore, as shown in FIG. 1*a*, the upper end 10*a* of the main slit 10 is located on one side of the upper opening 4, while the lower end 10*b* of the main slit is arranged in the vicinity of the lower opening 6 opposite the side, so that the slit extends diagonally on the ventral panel 2.

In the embodiment shown, the main slit 10 is extended over a front portion 7*a* of the hood 7, the front portion being in particular intended to cover the front portion of the neck of the wearer, the upper end 10*a* of the main slit being formed on the front portion. More precisely, the upper end 10*a* opens into the hood in order to allow for a complete opening of the slit 10 by separating the front portion 7*a* from the rest of the hood 7.

The suit comprises an additional slit 13 which extends in the dorsal panel 3 between two ends, respectively an upper end 13*a* and a lower end 13*b*, the additional slit being equipped with a reversible opening device in order to allow for a transversal release of the dorsal panel to make the suit easier to take off.

In the embodiment shown, the reversible opening device of the additional slit 13 also comprises a zip closure with a cursor 14 provided with a grip tab 15, the tab having, due to the dorsal position of the additional slit, a length that is sufficiently substantial, and in particular largely greater than the tab 12 of the main device, in order to allow the wearer to grasp it easily.

As such, through its orientation between two upper 13*a* and lower 13*b* ends, the additional slit 13 makes it possible, thanks to the transversal direction of the releasing of the dorsal panel 3 that it induces, to indirectly increase the transversal separation of the main slit 10, and therefore facilitate the putting on and the taking off of the suit by the wearer, and this without the assistance of another person.

Furthermore, in order to further increase the transversal release of the dorsal panel 3, the additional slit 13 can advantageously extend vertically on the dorsal panel.

In particular, the additional slit 13 extends over the dorsal panel 3 on the zone intended to be arranged facing the shoulder blades of the wearer, in order to allow for a local transversal release on the shoulders, i.e. the widest zone of the torso of the wearer, which generally causes the biggest problem when putting on or taking off the suit.

To do this, in relation with the figures, the lower end 13*b* of the additional slit 13 is arranged on the median portion of the dorsal panel 3, and in particular immediately under the zone of the shoulder blades.

Furthermore, the upper end 13*a* of the additional slit 13 is arranged at a distance from the upper opening 4, in order to prevent the interaction of the additional slit with the upper opening during the actuating of the opening device of the additional slit.

In particular, the additional slit 13 must have a length that is sufficient to allow for an effective transversal release of the dorsal panel 3. For example, the additional slit 13 can have a length of about 40 centimetres, in particular in the case of a suit intended for an adult wearer.

In the embodiment shown, the additional slit 13 is extended over a rear portion 7*b* of the hood 7, whereon the upper end 13*a* of the additional slit is formed. In an alternative not shown, when the suit is devoid of a hood 7, the upper end 13*a* of the additional slit 13 can be formed on a rear portion of the portion of the dorsal panel 3 intended to be arranged in the vicinity of the nape of the neck of the wearer.

Figure 2A:
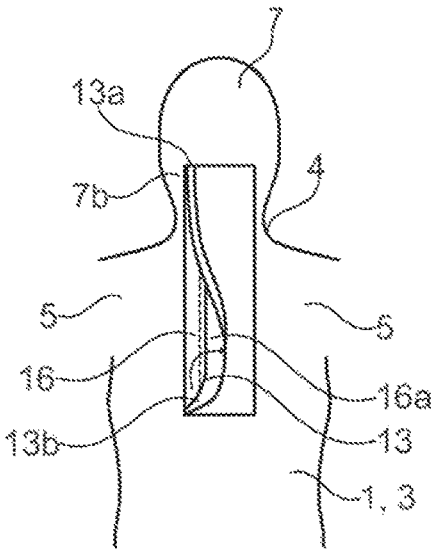
FIGS. 2*a* and 2*b* partially show as a view from the back the suit of FIGS. 1*a* to 1*c*, the additional slit being shown partially open as a view from the inside (FIG. 2*a*) and entirely open as a view from the outside (FIG. 2*b*).
Figure 2B:
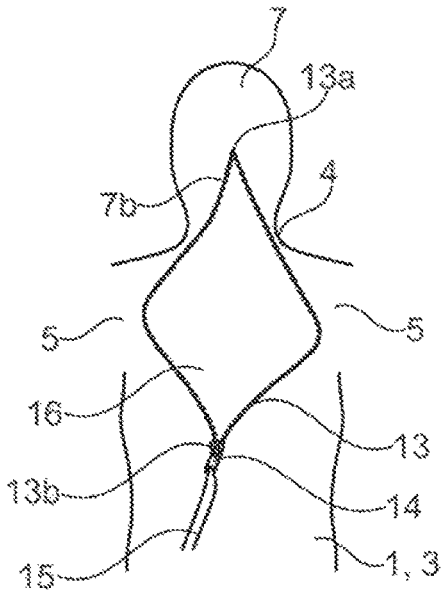

In relation with FIGS. 2*a*, 2*b*, the additional slit 13 is provided with a flap 16 that is arranged to hide the slit while still allowing for the opening thereof, in particular in order to prevent direct contact of the back of the wearer with the outside environment and/or to limit the intake of water through the open slit.

In particular, the flap 16 is associated on either side of the additional slit 13, in particular with waterproof seams and is reversibly deformable between a closed state and an open state of the additional slit.

To do this, the flap 16 can have a pleat of deformation, as shown in FIG. 2*a*, and/or be carried out with an elastic material base, for example with a perforated fabric of the mesh type.

What is claimed is:

1. A suit for aquatic activity having a central portion, the central portion being formed between a ventral panel and a dorsal panel which are connected to one another laterally by creating an upper opening, two lateral openings and two lower openings adapted for the passage of respectively the head, the two arms and the two legs of the wearer, the ventral panel having a main slit extending between the upper opening and a lower end, the main slit being equipped with a reversible opening device to allow the suit to be put on and taken off by transversely separating the ventral panel, wherein the suit comprises an additional slit which extends in the dorsal panel between two ends, respectively an upper end and a lower end, the additional slit being equipped with a reversible opening device in order to allow for a transversal release of the dorsal panel to make the suit easier to take off further wherein the upper opening is surmounted by a hood and at least one of the slits is extended over a portion of the hood whereon the upper end is formed.

2. The suit for aquatic activity according to claim 1, wherein the main slit extends over substantially the entire height of the ventral panel.

3. The suit for aquatic activity according to claim 2, wherein the upper end of the main slit is located on one side of the upper opening, the lower end of the main slit being arranged in the vicinity of the lower opening opposite the side.

4. The suit for aquatic activity according to claim 1, wherein the additional slit extends vertically in the dorsal panel.

5. The suit for aquatic activity according to claim 1, wherein the lower end of the additional slit is arranged on the median portion of the dorsal panel.

6. The suit for aquatic activity according to claim 1, wherein the upper end of the additional slit is arranged at a distance from the upper opening.

7. The suit for aquatic activity according to claim 1, wherein the additional slit is extended over a rear portion of the hood whereon the upper end of the additional slit is formed.

8. The suit for aquatic activity according to claim 1, wherein the main slit is extended over a front portion of the hood whereon the upper end of the main slit is formed.

9. The suit for aquatic activity according to claim 1, wherein the additional slit is provided with a flap that is arranged to hide the slit while still allowing for the opening thereof.

10. The suit for aquatic activity according to claim 9, wherein the flap is associated on either side of the slit, the flap being reversibly deformable between a closed state and an open state of the additional slit.

11. The suit for aquatic activity according to claim 10, wherein the flap has a pleat of deformation and/or is made from an elastic material.

12. The suit for aquatic activity according to claim 1, wherein the ventral and dorsal panels are made from a waterproof material and having an elasticity that is sufficient to adjust the central portion to the torso of the wearer.

13. The suit for aquatic activity according to claim 1, wherein the lateral and/or lower openings are provided with a sleeve for at least partially covering the arms and/or the legs of the wearer.

* * * * *